United States Patent [19]

Tezuka et al.

[11] Patent Number: 5,051,282

[45] Date of Patent: Sep. 24, 1991

[54] METHOD AND APPARATUS FOR WATER-REPELLENT PROCESSING OF TUBE

[75] Inventors: Sigeru Tezuka; Keishiro Kido, both of Saitama, Japan

[73] Assignee: Fuji Photo Film Co., Ltd., Kanagawa, Japan

[21] Appl. No.: 343,314

[22] Filed: Apr. 26, 1989

[30] Foreign Application Priority Data

| | | | |
|---|---|---|---|
| Apr. 28, 1988 | [JP] | Japan | 63-105687 |
| Apr. 28, 1988 | [JP] | Japan | 63-105688 |
| May 24, 1988 | [JP] | Japan | 63-126548 |
| Jun. 20, 1988 | [JP] | Japan | 63-151803 |

[51] Int. Cl.[5] ..... B05D 1/28; B05D 5/08; B05C 1/02

[52] U.S. Cl. ..... 427/260; 427/284; 427/287; 118/211; 118/232; 118/264; 118/DIG. 11

[58] Field of Search ..... 118/204, 264, 268, 270, 118/DIG. 11, 211, 232; 427/260, 284, 429, 287; 141/311 A; 73/864.01; 222/108

[56] References Cited

U.S. PATENT DOCUMENTS

| | | | |
|---|---|---|---|
| 2,304,832 | 12/1942 | Kofke et al. | 118/268 X |
| 3,101,283 | 8/1963 | Brown | 118/268 |
| 4,091,489 | 5/1978 | Nimetz | 118/268 X |
| 4,110,490 | 8/1978 | Westberg | 427/284 X |
| 4,347,875 | 9/1982 | Columbus | 141/18 |
| 4,413,587 | 11/1983 | Cook | 118/211 X |
| 4,705,551 | 11/1987 | Robinson, Jr. | 118/232 X |

FOREIGN PATENT DOCUMENTS

| | | |
|---|---|---|
| 1577921 | 9/1969 | Fed. Rep. of Germany . |
| 250661A1 | 10/1987 | German Democratic Rep. . |

OTHER PUBLICATIONS

Japanese Patent Gazette, Section Ch, p. 14 (Aug., 1984).

Hawley, G. G., "The Condensed Chemical Dictionary," Ninth Edition, New York, Van Nostraud Reinhold Co., 1977, p. 924.

*Primary Examiner*—Evan Lawrence

*Attorney, Agent, or Firm*—Sughrue, Mion, Zinn, Macpeak & Seas

[57] ABSTRACT

A water-repellent liquid is held in a liquid-retainable outer surface of a liquid-retainable member. A tube is held so that a portion near its tip comes into contact with the liquid-retainable surfaces while the former is rotated relative to the latter. As the tube is rotated with respect to the liquid-retainable surface, a water-repellent surface is formed on an outer surface of the tube near its tip. Two liquid-retainable members may be provided so that the tube is rotated therebetween.

21 Claims, 5 Drawing Sheets

METHOD AND APPARATUS FOR WATER-REPELLENT PROCESSING OF TUBE

BACKGROUND OF THE INVENTION

1. Field of the Invention

This invention relates to a method for water-repellent processing of a tip or the like of a tube and an apparatus used therefor.

In particular, this invention relates to a method and apparatus which are useful for forming a water-repellent surface on a portion of a nozzle of a metering pipette near the tip thereof, which pipette is used in chemical analyses for supplying a constant volume of a liquid sample.

2. Description of the Prior Art

Recently, dry-type clinical chemical analyses have been used widely because of the ease with which the analysis operations can be conducted, the speed with which measurements can be made and the like. In these analyses, a liquid sample to be tested for, e.g. blood or the like, is spotted on a chemical analysis slide which contains a reagent which reacts with a specific ingredient such as glucose or urea nitrogen (BUN) in the liquid sample; and then coloring, discoloring or the like which is caused by the reaction between the reagent and the specific ingredient is colorimetrically measured to determine the amount of the specific ingredient.

Conventionally, in order to spot the sample to be tested for (the liquid sample) on the chemical analysis slide, a predetermined amount of the sample is drawn into a pipette and then a circular drop of the sample is formed on a tip of the pipette so that it will come softly into contact with the center portion of the chemical analysis slide and be spotted thereon.

In such a method for spotting the sample, it is difficult to carry out analyses with a sufficient accuracy due to large differences in how individuals carry out the spotting of the sample. These differences mainly result from the fact that it is difficult to maintain a constant relationship between the position of the tip of the pipette (nozzle) and the surface of the chemical analysis slide on which the sample is spotted, and that, after the sample is drawn into the nozzle, a drop may not always form unless the liquid sample attached to the outside of the tip of the nozzle is wiped away.

One good way to eliminate the differences in the accuracy with which the liquid sample is spotted is to mount the pipette on a support and then to discharge manually or automatically the liquid sample out of the pipette. However, since the distance between the tip of the pipette and the sample-spotting surface of the chemical analysis slide is constant in this method, the drop cannot be brought into contact with the chemical slide and be spotted thereon after it has formed on the tip of the nozzle of the pipette.

The liquid sample may be whole blood, blood plasma, blood serum, dilute solutions thereof, urine, saliva, or the like which have various viscosities or the like and, accordingly, are absorbed into a liquid-receiving surface (a spreading layer in most cases) at different rates. Also, the rate at which one kind of liquid sample is absorbed into the liquid receiving surface may differ for various kinds of analysis slides which are used according to the ingredients to be detected. When the rate at which the liquid sample is discharged from the pipette is much higher than the rate at which it is absorbed into the chemical analysis slide, a part of the drop may attach itself to the circumference of the tip and remain there, and thereby an error may occur in the amount of the liquid sample spotted. Namely, the amount of the liquid sample supplied to the chemical analysis slide decreases when the drop is attached to the circumference of the tip, and the attached drop is additionally spotted on the chemical analysis slide in the next spotting operation. Thereby a positive error occurs in the amount of the liquid sample thus spotted.

In order to prevent the drop from attaching itself to the outer surface of the tube near the tip of the nozzle, it has been proposed to form only the outer surface of the tube from a water-repellent material. However, when the nozzle has such a twofold structure, the process for making the nozzle is complicated and the cost therefor increases.

Also, it is troublesome to wipe away the liquid sample attached to the outer surface of the tip of the nozzle each time the liquid sample is drawn thereinto. Such a wiping operation will be forgotten and, accordingly, an error will occur in the amount of the liquid sample unless attention is paid thereto.

SUMMARY OF THE INVENTION

In order to prevent a part of a liquid from attaching itself to an outer portion of an open tip, such as a nozzle, of a tube such as a pipette when a predetermined amount of the liquid is totally or partially and repeatedly discharged therefrom, the object of the present invention is to provide a method for forming a water-repellent surface on an outer surface of the tip and an apparatus for carrying out the method.

Another object of the present invention is to provide a method for forming a water-repellent surface on an outer portion of a metering pipette near a tip of a nozzle so that a highly accurate amount of a liquid sample is totally or partially and repeatedly dropped therefrom while no part thereof is allowed to attach itself to the outer portion of the tube near the tip.

The present invention provides a method comprising the steps of providing a liquid-retainable member having a liquid-retainable outer surface; keeping a water-repellent liquid on said liquid-retainable outer surface; bringing a portion of a tube into contact with said liquid-retainable outer surface, said portion of the tube being located near a tip thereof; and thereby forming a water-repellent surface on said portion of the tube.

Also, the present invention provides an apparatus comprising a liquid-retainable member having a liquid-retainable outer surface; holding means for holding a tube so that a portion thereof near a tip thereof contacts said liquid-retainable outer surface while said portion of the tube is rotated relative to said liquid-retainable outer surface; and a water-repellent liquid held on said liquid-retainable outer surface.

The tube which is subjected to water-repellent processing in accordance with the present invention preferably has a circular cross section although it may have other cross-sectional shapes such as ellipsoidal, polygonal or the like. Although the tube to be processed (e.g. The nozzle of a pipette) may have a constant or variable outer diameter along its length, it is preferred that the profiles of both outer surfaces of at least a portion of the tube near its tip are made up of linear segments.

In order to provide a liquid-retainable surface on the outer surface of the liquid-retainable member, cloth, felt, paper, nonwoven cloth, cord, string or the like is wound around or attached to an outer portion of the liquid-retainable member. Preferably, the liquid-retainable member is made of a soft material so that it will be dented a little when the portion of the tube near the tip thereof contacts it. Thereby a relatively large area of the outer portion of the tube can come into contact with it. All of the liquid-retainable member or all of it except for the center thereof may be made of a liquid-retainable material.

In cases where the tube has a constant outer diameter, it is preferred that the liquid-retainable member has a columnar shape and the liquid-retainable surface is formed on a periphery thereof. In cases where the portion of the tube near the tip thereof is like a truncated cone, it is preferred that the liquid-retainable member has the shape of a truncated cone and the liquid-retainable surface is formed on a periphery thereof.

Also, two separate liquid-retainable members may be provided so that their two liquid-retainable outer surfaces can simultaneously contact the portion of the tube near the tip thereof and the tube can be rotated between these two outer surfaces. Both of the two liquid-retainable outer surfaces may be plane. Also, they may have partially or wholly columnar-shaped surfaces. Further, the liquid-retainable surface of one of the members may be plane, while that of the other may have a partially or wholly columnar-shaped surface.

Two liquid-retainable members which have liquid-retainable surfaces movable in parallel in directions opposite to each other are advantageous for rotating therebetween the portion of the tube near its tip. Namely, when the two liquid-retainable members are plate-like members having liquid-retainable outer surfaces lying opposite each other, they can be moved in parallel in opposite directions so that the portion of the tube near its tip is sandwiched and rotated therebetween.

When the two liquid-retainable members are columnar or cylindrical, it is advantageous to rotate them in the same direction in order to sandwich and rotate the portion of the tube near its tip between their peripheries.

As the water-repellent liquid used for forming the water-repellent surface near the tip of the tube, silicone oil which is widely used as a water-repellent agent is preferred in view of its availability, cost and the like. However, a water-repellent liquid which can attach itself to the outer surface of the portion of the tube near the tip thereof may be selected from vegetable oils, animal oils, mineral oils, synthetic esters, higher alcohols or the like and used therefor. The water-repellent liquid may contain solvents which have a suitable volatility.

The present invention is useful for water-repellent processing of the near-the-tip portion of liquid-injection nozzles of pipettes used for metering liquid samples, reagents, and the like in clinical chemical analyses. Most pipettes used for spotting liquids on chemical analysis slides or the like have a cylinder and a piston. The pipette may have a fixed nozzle or a detachable or disposable nozzle tip. As the nozzle tip, one disclosed in U.S. Pat. No. 4,072,330, U.S. Pat. No. 4,237,095 or U.S. Pat. No. 4,347,875, for example can be used. Most of the commercially-available nozzle tips are made of polypropyrene in view of the accuracy with which it can be processed. The outer diameter of the tip of the nozzle of the pipette is usually in the range of 0.3 to 1.5 mm and preferably in the range of 0.5 to 1.2 mm.

Although the application of the present invention is not restricted by the outer diameter of the tube, the present invention is useful for cases where a drop of liquid is formed on the portion of the tube near its tip. Accordingly, practical effects may be hard to obtain when the outer diameter of the tube exceeds 5 mm.

When the present invention is applied to a pipette or the like having a detachable nozzle, the length of the nozzle is not restricted particularly. However, the nozzle should have a sufficient length so that it can be held at a position from which it contacts the liquid-retainable outer surface. In the case of disposable nozzle tips or the like, the length of the nozzle is automatically determined by the desired amount of the liquid to be accommodated therein.

When the outer diameter of the nozzle is in the range of 0.5 to 3 mm, a portion of it having a length of not more than about 10 mm is sufficient for being subjected to the water-repellent processing. The effectiveness in preventing liquids from running down the outer surface of the nozzle may be lowered in cases where a portion having a length of more than about 10 mm is subjected to water-repellent processing. Preferably, a portion having a length in the range of 3 to 10 mm is subjected to the water-repellent processing. The portion to be subjected to the water-repellent processing may or may not include the tip of the nozzle. Preferably, when the outer diameter of the nozzle is in the range of 0.5 to 3 mm, a portion starting at the tip of the nozzle and extending 0.3 to 1.2 mm toward the top of the nozzle is excluded from the water-repellent processing.

When a predetermined amount of liquid is totally or partially and repeatedly discharged from the tip of an open tube, such as a nozzle of a pipette or the like used in analyses, which tube has been processed in accordance with the present invention, none of the liquid is allowed to attach itself to an outer portion of the tube near the tip thereof. Accordingly, neither positive nor negative errors occur in the amount of the liquid dropped therefrom. Therefore, the accuracy of quantitative chemical analyses such as those concerning the amounts of specific ingredients in liquids can be improved.

Also, according to the present invention, the liquid, which attaches itself to an upper portion of the outer surface of the nozzle of the pipette when the nozzle is dipped relatively deeply into the liquid, is prevented from running down the outer surface of the nozzle and joining the liquid discharged from the nozzle (thereby causing positive errors in the amount of the dropped liquid).

The present invention is applicable not only to pipettes but also to burettes or the like which are used in quantitative analyses. Also, the present invention is useful not only for liquid-metering containers used in chemical analyses but also for cases where it is important always to form a drop of a liquid which has a relatively constant size (e.g. in intravenous drips where the flow rate is controlled on the basis of the number of drops).

DESCRIPTION OF THE PREFERRED EMBODIMENTS

The present invention will hereinbelow be described in further detail with reference to the accompanying drawings.

Figure 1:
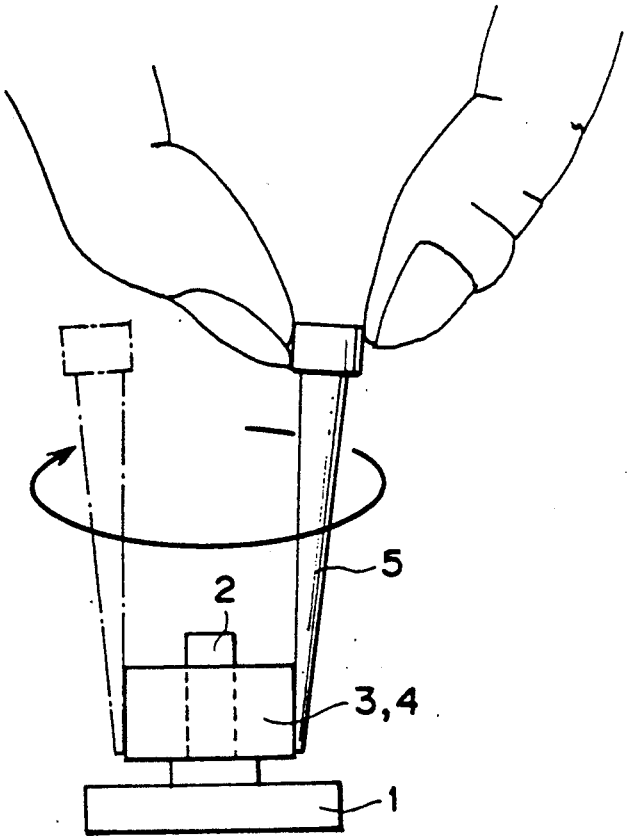
FIG. 1 is an elevational view showing an apparatus in accordance with the first embodiment of the present invention.

FIG. 1 shows an apparatus in accordance with the first embodiment of the present invention which comprises a support 1, a shaft 2, a columnar member 3, and a liquid-retainable member 4 which constitutes the periphery of the columnar member 3. Also, this drawing shows a tube 5 which is to be processed. The shaft 2 and the columnar member 3 are fixed to the support 1. The shaft 2 is disposed along an axis of the columnar member 3. The liquid-retainable member 4 is made of felt.

The liquid-retainable member 4 is impregnated with commercially-available silicone oil. The upper end of the tube 5 to be processed, e.g. The nozzle tip of a micropipette, is held by a hand so that the nozzle tip faces downward and the tip of the tube 5 contacts the liquid-retainable member 4. The tip of the tube 5 is moved around the columnar member 3 as indicated in the drawing. As the tube 5 is held and rotated, the whole periphery of the tip of the tube 5 comes into contact with the liquid-retainable member 4 of the columnar member 3 in the course of one round of travel. Accordingly, silicone oil is attached to the whole periphery of the tube 5 near its tip portion so that a water-repellent surface is formed thereon. In this way, the water-repellent surface is formed on the outer surface of the tube 5 near its tip.

Figure 2:
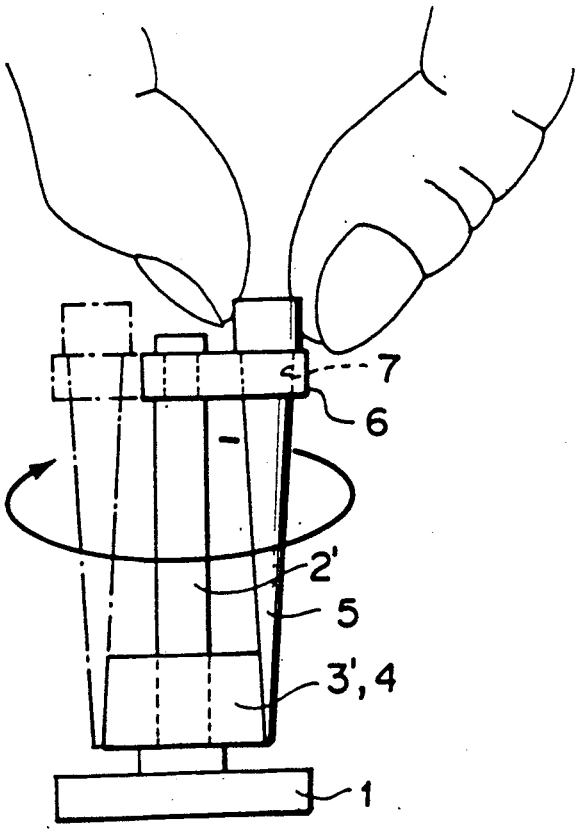
FIG. 2 is an elevational view showing an apparatus in accordance with the second embodiment of the present invention.

FIG. 2 shows an apparatus in accordance with the second embodiment of the present invention. This apparatus is the same as that of the first embodiment except that a truncated cone-like member 3' is provided in place of the columnar member 3 and an arm 6 is additionally provided. The arm 6 is rotatable around the shaft 2 and has an opening 7 which is disposed at the center portion thereof and in which the tube 5 is rotatably supported.

The tube 5 is inserted into the opening 7 of the arm 6 and rotated as in the case of the first embodiment so that a water-repellent surface is formed on the whole periphery of the tube 5 near its tip portion.

Figure 3A:
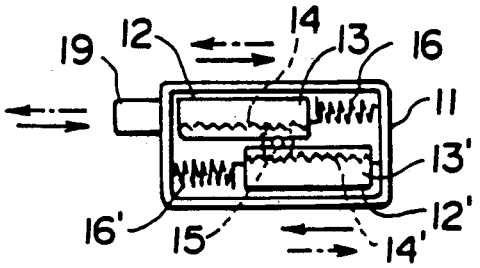
FIGS. 3A, 3B and 3C are section views showing cross sections of an apparatus in accordance with the third embodiment of the present invention which are taken from three different directions.
Figure 3B:
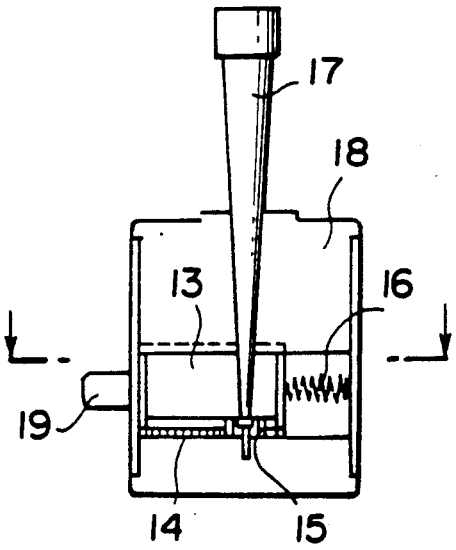
Figure 3C:
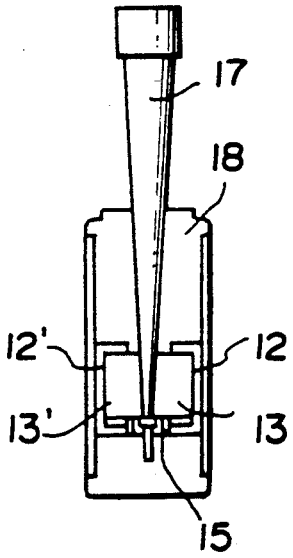

FIGS. 3A, 3B and 3C are section views showing cross sections of an apparatus in accordance with the third embodiment of the present invention. The apparatus shown in these drawings comprises a housing 11, holders 12 and 12', liquid-retainable members 13 and 13' which are respectively held in the holders 12 and 12', racks 14 and 14' respectively disposed on one edge of the holders 12 and 12', a pinion 15 meshed with the racks 14 and 14', springs 16 and 16' which urge the holders 12 and 12' in opposite directions, a tube-supporting member 18 for supporting a tube 17, and a knob 19 for horizontally moving the holder 12 against the force of the spring 16. The liquid-retainable members 13 and 13' are fixed to the retracted surfaces of the holder 12 and 12', respectively. The liquid-retainable members 13 and 13' can contact the tube 17 which is held in the tube-supporting member 18. The tube-supporting member 18 has an opening at the center portion thereof, in which opening the tube 17 is rotatably supported. The liquid-retainable members 13 and 13' are made of felt.

The whole surface area of the liquid-retainable members is impregnated with an appropriate amount of commercially-available silicone oil. The tube 17 to be processed, e.g. The nozzle tip of a micropipette, is downwardly inserted into the opening of the tube-supporting member 18. When the knob 19 is pushed by a finger, the holder 12 is moved rightward in FIG. 3A against the force of the spring 16. At the same time, the rack 14 moves rightward and thereby the rack 14' is moved leftward via the pinion 15 which is meshed with these racks 14 and 14'. Accordingly, the holder 12' which is united with the rack 14' is moved in the direction opposite to that in which the holder 12 is moved. Therefore, the tube 17 which is sandwiched between the holders 12 and 12' is rotated in a clockwise direction.

As the tip of the tube 17 is rotated while being in contact with the liquid-retainable members 13 and 13', the whole periphery of the tube 17 near its tip comes into contact with the liquid-retainable members 13 and 13'. Accordingly, the silicone oil is attached to the whole periphery of the tube 17 near its tip portion so that a water-repellent surface is formed thereon. In this way, the water-repellent surface is formed on the outer surface of the tube 17 near its tip.

Figure 4:
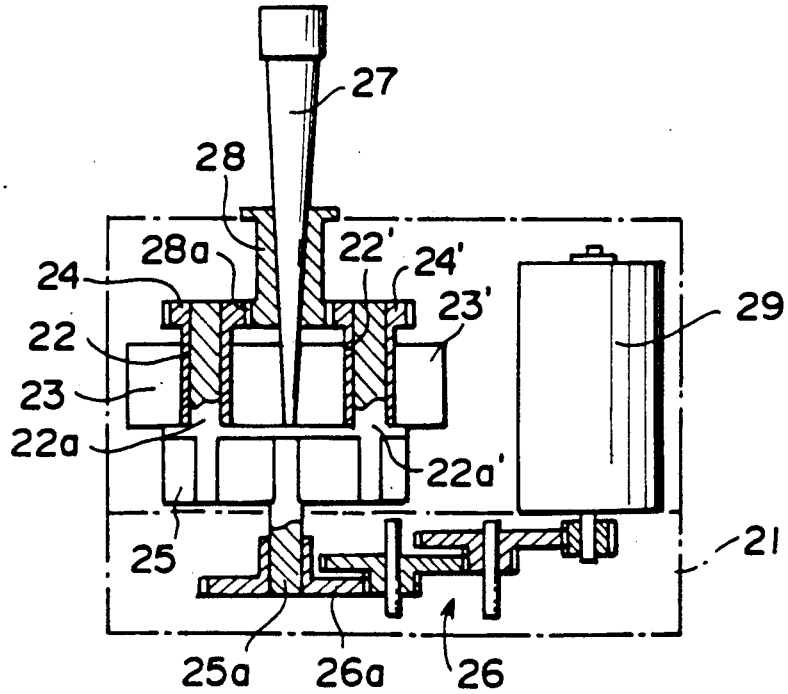
FIG. 4 is a section view showing an apparatus in accordance with the forth embodiment of the present invention.

FIG. 4 shows an apparatus in accordance with a fourth embodiment of the present invention. This apparatus comprises a housing 21 which also functions as a support, columnar members 22 and 22', liquid-retainable members 23 and 23' which respectively surround the columnar members 22 and 22', gears 24 and 24' which are respectively fixed to the columnar members 22 and 22', a rotatable member 25 which rotates around a shaft **25*a*, a set of gears 26 for rotating the rotatable member 25, a tube-supporting member 28 for supporting a tube 27, a fixed gear 28*a* which is disposed on an edge of the tube-supporting member 28 and is meshed with the gears 24 and 24', and a motor 29. The columnar members 22 and 22' are rotatable around shafts 22*a* and 22*a'* which are fixed to the rotatable member 25. The liquid-retainable members 23 and 23', which are disposed on the peripheries of the columnar members 22 and 22', contact the tube 27 supported by the tube-supporting member 28. The tube-supporting member 28 has an opening at its center portion and is fixed to the housing 21, through which opening the tube 27 is inserted. The tube 27 is rotatably supported by the tube-supporting member 28. The liquid-retainable members 23 and 23' are made of sponge (foamed plastics). The motor 29** is connected to an electric source (not shown) by way of a switch (not shown).

While the motor 29 is not moving the liquid-retainable members 23 and 23' are impregnated with commercially-available silicone oil, and the tube 27 to be processed, e.g. The nozzle tip of a micropipette, is downwardly inserted into the opening of the tube-supporting member 28. As the motor 29 rotates, the rotatable member 25 rotates around the shaft 25*a* via the set of gears 26. Accordingly, the gears 24 and 24' go around the gear 28*a*, while respectively rotating around the shafts 22*a* and 22'*a*. The columnar members 22 and 22' to which the gears 24 and 24' are fixed and, consequently, the liquid-retainable members 23 and 23' are subjected to similar rotational movements. As the tip of the tube 27 is rotated while being in contact with the liquid-retainable members 23 and 23', the whole periphery of the tube 27 near its tip comes into contact with the liquid-retainable members 23 and 23'. Accordingly, the silicone oil is attached to the whole periphery of the tube 27 near its tip portion so that a water-repellent surface is formed thereon. In this way, the water-repellent surface is formed on the outer surface of the tube 27 near its tip.

Figure 5A:
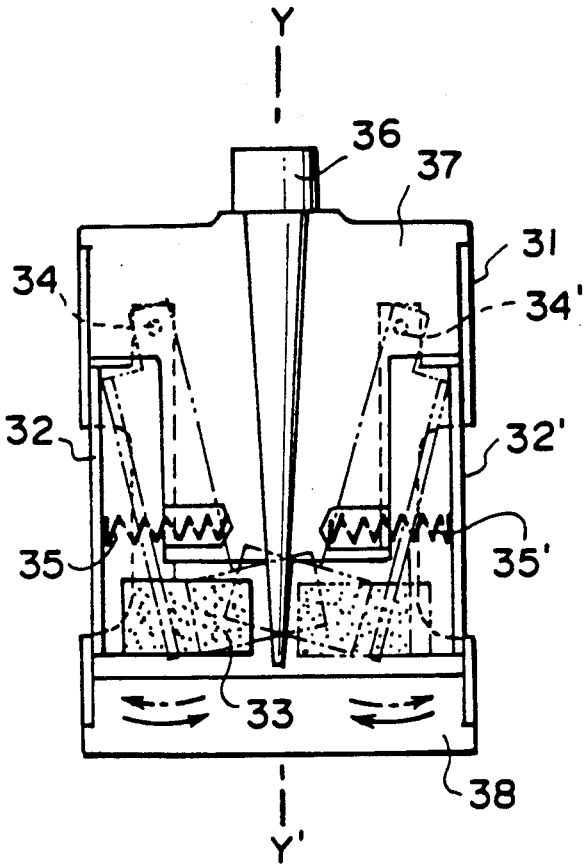
FIGS. 5A, 5B and 5C are section views showing cross sections of an apparatus in accordance with the fifth embodiment of the present invention which are taken from three different directions.
Figure 5B:
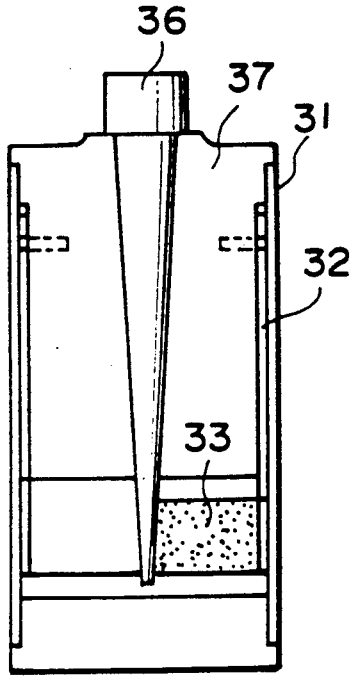
Figure 5C:
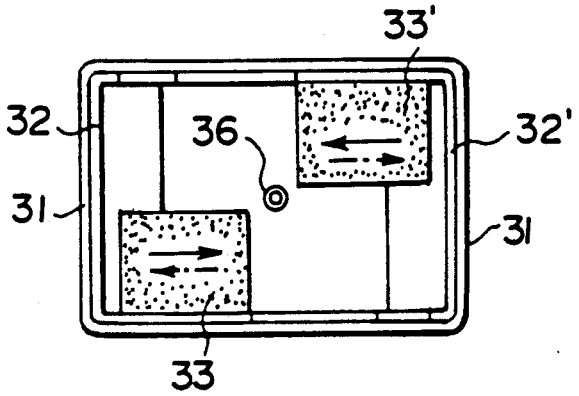

FIGS. 5A, 5B and 5C are section views showing cross sections of an apparatus in accordance with a fifth embodiment of the present invention which are taken from three different directions. FIG. 5B shows a cross section taken along line Y—Y' of FIG. 5A. FIG. 5C shows a bottom view of the apparatus from which a bottom plate 38 is taken away. The apparatus shown in these drawings comprises a housing 31, holders 32 and 32', liquid-retainable members 33 and 33' which are respectively fixed to lower ends of the holders 32 and 32', fixed shafts 34 and 34' around which the holders 32 and 32' are rotatable, springs 35 and 35' respectively urging the holders 32 and 32' in opposite, a tube-supporting member 37 for supporting a tube 36, and the bottom plate 38. The liquid-retainable members 33 and 33' have a rectangular parallelepiped shape. One side of each of the liquid-retainable members 33 and 33' can contact the tube 36 which is supported by the tube-supporting member 37. The tube-supporting member 37 has an opening through which the tube 36 is inserted and at which the tube 36 is rotatably supported. The liquid-retainable members 33 and 33' are made of open cell foamed plastic sponge.

Figure 6A:
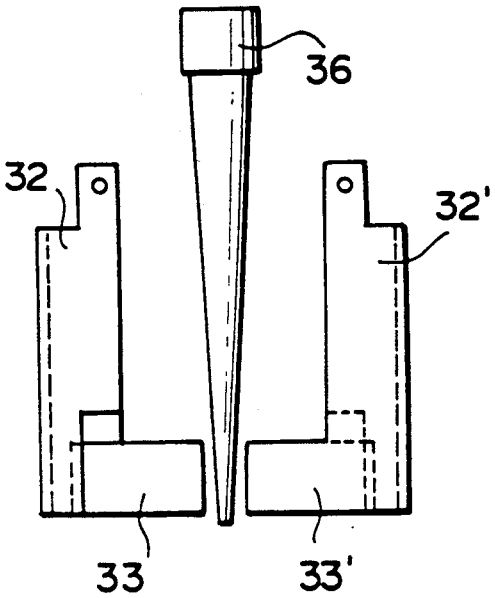
FIGS. 6A, 6B, 6C and 6D are schematic views showing major parts of the apparatus in accordance with the fifth embodiment of the present invention.
Figure 6B:
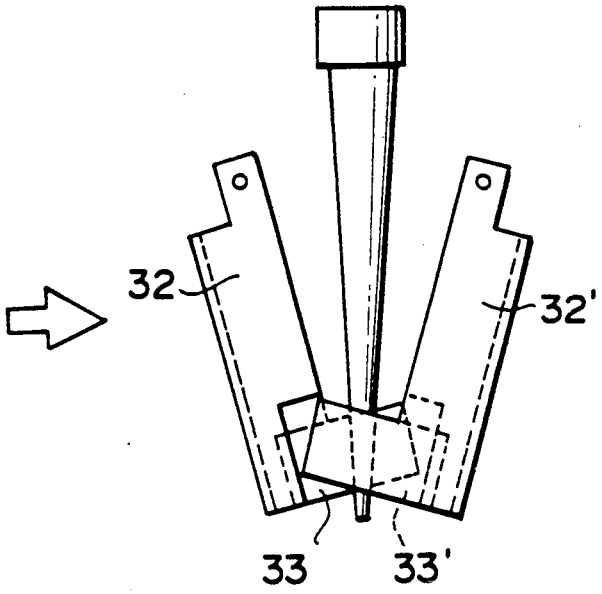
Figure 6C:
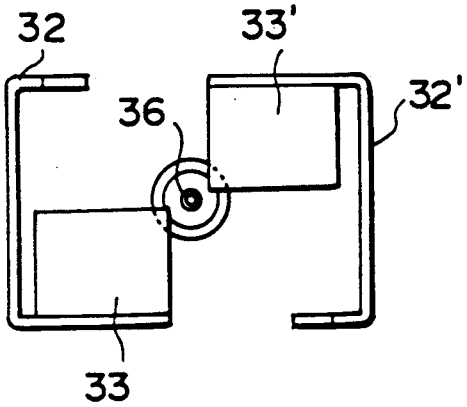
Figure 6D:
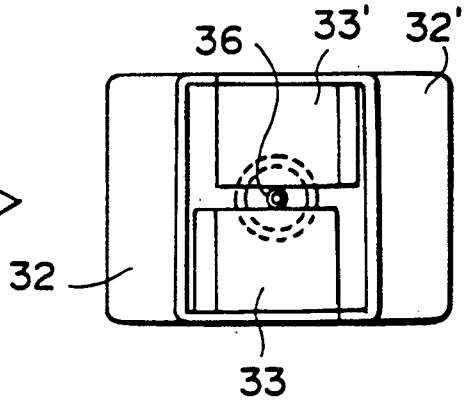

The whole surface area of the liquid-retainable members 33 and 33' is impregnated with an appropriate amount of commercially-available silicone oil, and the tube 36 to be processed, e.g. The nozzle tip of a micropipette, is downwardly inserted into the opening of the tube-supporting member 37. At this moment, the tube 36 does not contact the liquid-retainable members 33 and 33' (cf. FIGS. 5A, 5C, 6A and 6C). When the backs of the holders 32 and 32' are pushed inward by a finger, the holder 32 is moved rightward against the force of the spring 35, while the holder 32' is moved leftward against the force of the spring 35' in these drawings. Accordingly, the liquid-retainable members 33 and 33' come into contact with the tube 36, and the tube 36 is rotated in a clockwise direction as viewed from the top (cf. FIGS. 6B and 6D). The tip of the tube 36 is positioned lower than the liquid-retainable members 33 and 33' so as not to contact them. As the portion of the tube 36 near its tip is rotated while being in contact with the liquid-retainable members 33 and 33', the whole periphery of the tube 36 near its tip comes into contact with the liquid-retainable members 33 and 33'. Accordingly, silicone oil is attached to the whole periphery of the tube 36 near its tip portion so that a water-repellent surface is formed thereon, while it is prevented from attaching itself to the tip of the tube 36. In this way, the water-repellent surface is formed on the outer surface of the tube 36 near but not on its tip.

Figure 7:
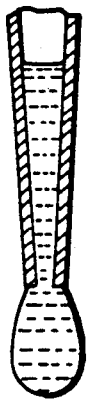
FIG. 7 is a schematic view showing a drop of a liquid formed on a nozzle tip which has been processed in accordance with the present invention.
Figure 8:
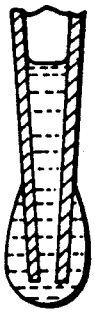
FIG.8 PRIOR ART
FIG. 8 is a schematic view showing a drop of a liquid formed on a nozzle tip (according to the prior art) in which a water-repellent surface has not been formed on the periphery thereof.

FIG. 7 shows a drop of a liquid formed on a nozzle tip which has been processed in accordance with the present invention, while FIG. 8 shows that formed on a nozzle tip (according to the prior art) in which a water-repellent surface has not been formed on the periphery thereof.

We claim:

1. A method for water-repellent processing of a pipette, said pipette being used in chemical analyses for supplying a constant volume of a liquid sample, the method comprising the steps of providing a liquid-retainable member having a liquid-retainable outer surface; keeping a water-repellent liquid on said liquid-retainable outer surface; bringing a portion of said pipette into contact with said liquid-retainable outer surface, said portion of the pipette being located near a tip thereof; and thereby forming a water-repellent surface on said portion of the pipette to attendantly prevent a part of said liquid sample from attaching itself to said portion of the pipette, and wherein said liquid-retainable member has a columnar shape and said liquid-retainable outer surface is formed on a periphery thereof.

2. A method as defined in claim 1 in which said liquid-retainable outer surface is made of a soft material.

3. A method as defined in claim 1 in which said portion of the pipette is rotated while being in contact with said liquid-retainable outer surface.

4. A method as defined in claim 1 in which said portion of the pipette is rotated while being in contact with and moved along said liquid-retainable outer surface.

5. A method as defined in claim 1 in which said tip is excluded from said portion of the pipette.

6. A method for water-repellent processing of a tube comprising the steps of providing a liquid-retainable member having a liquid-retainable outer surface; keeping a water-repellent liquid on said liquid-retainable outer surface; bringing a portion of a tube into contact with said liquid-retainable outer surface, said portion of the tube being located near a tip thereof; and thereby forming a water-repellent surface on said portion of the tube, in which said liquid-retainable member has a truncated cone-like shape, and said liquid-retainable outer surface is formed on a periphery thereof.

7. A method for water-repellent processing of a tube comprising the steps of providing a liquid-retainable member means having a liquid-retainable outer surface; keeping a water-repellent liquid on said liquid-retainable outer surface; bringing a portion of a tube into contact with said liquid-retainable outer surface, said portion of the tube being located near a tip thereof; and thereby forming a water-repellent surface on said portion of the tube, in which said liquid-retainable member means comprises two separate members each having a liquid-retainable outer surface.

8. A method as defined in claim 7 in which said portion of the tube is brought into contact with the liquid-retainable outer surfaces of said two separate members simultaneously and is rotated therebetween.

9. A method as defined in claim 7 in which both of the liquid-retainable outer surfaces of said two separate members are plane.

10. A method as defined in claim 7 in which the liquid-retainable outer surface of one of said two-separate members is plane and the liquid-retainable outer surface of the other has a partially or wholly columnar-shaped surface.

11. A method as defined in claim 7 in which both of said two separate members have a columnar or cylindrical shape.

12. An apparatus for forming a water-repellent surface on an outer surface of a pipette near a tip thereof, said pipette being used in chemical analyses for supplying a constant volume of a liquid sample, the apparatus comprising a liquid-retainable member having a liquid-retainable outer surface; holding means for holding said pipette so that a portion of the pipette contacts said liquid-retainable outer surface while said portion of the pipette is rotated relative to said liquid-retainable outer surface; and a water-repellent liquid held on said liquid-retainable outer surface, said water-repellent surface attendantly preventing a part of said liquid sample from attaching itself to said portion of the pipette.

13. An apparatus as defined in claim 12 in which said liquid-retainable outer surface is made of a soft material.

14. An apparatus as defined in claim 12 in which said liquid-retainable member has a columnar shape and said liquid-retainable outer surface is formed on a periphery thereof.

15. An apparatus as defined in claim 12 in which said holding means is adapted to hold said pipette so that the tip of said pipette is prevented from contacting said liquid-retainable outer surface.

16. An apparatus for forming a water-repellent surface on an outer surface of a tube near a tip thereof, comprising a liquid-retainable member having a liquid-retainable outer surface; holding means for holding said tube so that a portion of the tube contacts said liquid-retainable outer surface while said portion of the tube is rotated relative to said liquid-retainable outer surface; and a water-repellent liquid held on said liquid-retainable outer surface, in which said liquid-retainable member has a truncated cone-like shape, and said liquid-retainable outer surface is formed on a periphery thereof.

17. An apparatus for forming a water-repellent surface on an outer surface of a tube near a tip thereof comprising a liquid-retainable member means having a liquid-retainable outer surface; holding means having a liquid-retainable outer surface; holding means for holding said tube so that a portion of the tube contacts said liquid-retainable outer surface while said portion of the tube is rotated relative to said liquid-retainable outer surface; and a water-repellent liquid held on said liquid-retainable outer surface, in which said liquid-retainable member means comprises two separate members each having a liquid-retainable outer surface.

18. An apparatus as defined in claim 17 in which said holding means is adapted to hold said tube so that said portion of the tube is brought into contact with the liquid-retainable outer surfaces of said two separate members simultaneously and is rotated therebetween.

19. An apparatus as defined in claim 18 in which the liquid-retainable outer surfaces of said two separate members are adapted to move in parallel in opposite directions.

20. An apparatus as defined in claim 17 in which both of the liquid-retainable outer surfaces of said two separate members are plane.

21. An apparatus as defined in claim 17 in which both of said two separate members have a columnar or cylindrical shape and are rotatable.

* * * * *